US006489928B2

(12) United States Patent
Sakurada

(10) Patent No.: US 6,489,928 B2
(45) Date of Patent: Dec. 3, 2002

(54) COMPOSITE DIELECTRIC MOLDED PRODUCT AND LENS ANTENNA USING THE SAME

(75) Inventor: Kiyoyasu Sakurada, Moriyama (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/978,745

(22) Filed: Oct. 17, 2001

(65) Prior Publication Data

US 2002/0067317 A1 Jun. 6, 2002

(30) Foreign Application Priority Data

Oct. 18, 2000 (JP) ..... 2000-318362
Apr. 11, 2001 (JP) ..... 2001-112816

(51) Int. Cl.[7] ..... H01Q 19/06

(52) U.S. Cl. ..... 343/753; 343/909; 343/911 R; 75/230; 428/209; 419/10

(58) Field of Search ..... 343/753, 909, 343/911 R, 910, 911 L; 75/230; 428/209, 325, 548; 419/10, 29; H01Q 19/06

(56) References Cited

U.S. PATENT DOCUMENTS 5,098,940 A * 3/1992 Brooks ..... 524/227
5,358,775 A * 10/1994 Horn ..... 428/209
5,745,082 A * 4/1998 Akler ..... 343/753
5,952,984 A * 9/1999 Kuramoto et al. ..... 343/911 R
6,391,082 B1 * 5/2002 Holl ..... 75/230

FOREIGN PATENT DOCUMENTS

JP 0 780 847 A * 6/1997 ..... H01B/3/30
JP 10237303 * 9/1998 ..... C08L/81/02
JP 1 006 611 A * 6/2000 ..... H01Q/19/08

OTHER PUBLICATIONS

Hoechst Celanese Corp, Jun. 1997, Poly(Phenylene Sulfide) Composites Having a High Dielectric Constant, pp. 1–38.*
Hoechst Celanese Corp, Jun. 1998, Cyclic Olefin Polymer Composites Having Dielectric Constant, pp. 1–20.*

* cited by examiner

*Primary Examiner*—Tho G. Phan
(74) *Attorney, Agent, or Firm*—Dickstein, Shapiro, Morin & Oshinsky, LLP.

(57) ABSTRACT

Provided is a composite dielectric molded product exhibiting excellent properties such as the antenna gain and side lobe, etc. when used for a lens antenna, and exhibiting less variation of properties in one individual product and between individual products. The composite dielectric molded product is formed by molding a composite dielectric material containing a dielectric inorganic filler and an organic polymer material so that the dielectric constant anisotropy is in the range of about 1.00 to 1.05.

20 Claims, 2 Drawing Sheets

COMPOSITE DIELECTRIC MOLDED PRODUCT AND LENS ANTENNA USING THE SAME

BACKGROUND OF THE INVENTION

1. Field of the Invention

The present invention relates to a composite dielectric molded product, and particularly to a composite dielectric molded product and a lens antenna using the same.

2. Description of the Related Art

In recent years, intelligent transport systems (ITS) for the next generation have been actively developed, and functions for supporting safe cruise driving have been increasingly developed. Particularly, an external environmental detection system of the ITS, functioning as the eye of an automobile, has been considered as most important, and detection systems using infrared rays, CCD or the like, have been developed. However, these detection systems have the problem of failing in the rain, and increasing the cost.

Therefore, a radar utilizing a millimeter wave (76 GHz) is considered to be used as external environmental detection means. Examples of such a milli-wave antenna include a planar antenna having a planar outgoing plane, a lens antenna having a convexly curved outgoing plane, and the like. The lens antenna is considered particularly excellent in antenna efficiency and detection angle.

Such a lens antenna generally comprises a lens body having a convex outgoing plane and a primary transmitter provided behind the lens body. Particularly, a composite dielectric material comprising a resin and a dielectric inorganic filler exhibiting a high dielectric constant even with a small thickness and excellent productivity is used as the material for the lens body for an on-vehicle lens antenna in which the thickness of the lens body must be decreased. The lens body is generally molded by injection molding from the viewpoint of molding cost and molding precision.

However, the values of antenna gain and side lobe of a lens antenna in a lens body (composite dielectric molded product) obtained by molding a conventional composite dielectric material cannot be achieved according to design, and variation occurs in characteristics to deteriorate yield.

SUMMARY OF THE INVENTION

Accordingly, it is an object of the present invention to provide a composite dielectric molded product exhibiting excellent properties such as antenna gain, side lobe, etc. when used for a lens antenna, and exhibiting less variation of properties in one individual product and between individual products.

In order to achieve the object of the present invention, a composite dielectric molded product in accordance with a first aspect, comprises a composite dielectric material containing a dielectric inorganic filler and an organic polymer material, wherein the dielectric constant anisotropy is in the range of about 1.00 to 1.05. The dielectric constant anisotropy represents the ratio (A/B) of dielectric constant A in the direction in which the dielectric constant is maximum to dielectric constant B in the direction in which the dielectric constant is minimum.

By using the composite dielectric material and controlling the dielectric constant anisotropy of the obtained molded product, a composite dielectric molded product having excellent electric properties and less variation in properties can be obtained. With attention to the fact that the dielectric constant of a composite dielectric molded product varies with the direction of an electric field depending upon the composite dielectric material used and molding conditions, the inventors found that the composite dielectric molded product exhibiting large variation in the dielectric constant produced an electric field direction in which the desired dielectric constant property cannot be obtained and in which there was variation in properties of the composite dielectric molded product. Therefore, it was found that by decreasing the variation in the dielectric constant with respect to the electric field direction, i.e., by controlling dielectric constant anisotropy to about 1.00 to 1.05, the above-described problem could be resolved, leading to the achievement of the present invention.

In a composite dielectric molded product according to a second aspect of the present invention, the composite dielectric material preferably has a melt viscosity of about 170 Pa·s or more at a shear rate of 1000 $S^{-1}$ during molding. With such a melt viscosity, the dielectric constant anisotropy can be controlled in the range of about 1.00 to 1.05 even in an injection molding method in which the dielectric constant anisotropy of the composite dielectric molded product is liable to increase.

In a composite dielectric molded product according to a third aspect of the present invention, the organic polymer material preferably comprises a thermoplastic resin. By using this organic polymer material, the composite dielectric material can be molded by injection molding, thereby decreasing production cost and permitting easy molding with high precision of form.

In a composite dielectric molded product according to a fourth aspect of the present invention, the organic polymer material preferably comprises a thermoplastic resin containing a resin filler. By using such an organic polymer material, the dielectric constant anisotropy can be decreased because the orientation of the dielectric inorganic filler is suppressed by the resin filler.

In a composite dielectric molded product according to a fifth aspect of the present invention, the dielectric inorganic filler preferably comprises at least one oxide, carbonate, phosphate or silicate of IIa, IVa, IIIb or IVb group elements, and compound oxides containing IIa, IVa, IIIb or IVb group elements. By using such a dielectric inorganic filler, a high dielectric constant can be obtained even when the composite dielectric molded product has a small thickness.

A lens antenna according to a sixth aspect of the present invention comprises at least a lens unit having a convex outgoing plane and a primary transmitter provided behind the lens unit, wherein the lens unit comprises a composite dielectric molded product in accordance with any one of the first to fourth aspects of the present invention. In the lens antenna having this construction, the antenna gain can be increased, and the side lobe and variation in properties can be decreased.

In a lens antenna according to a seventh aspect of the present invention, the lens unit preferably comprises a lens body and a matching layer formed on the surface of the lens body, for matching the lens body with the air. By providing the matching layer on the lens body, reflection of electromagnetic waves can be further suppressed during emission and reception of electromagnetic waves.

DESCRIPTION OF THE PREFERRED EMBODIMENTS

Figure 1:
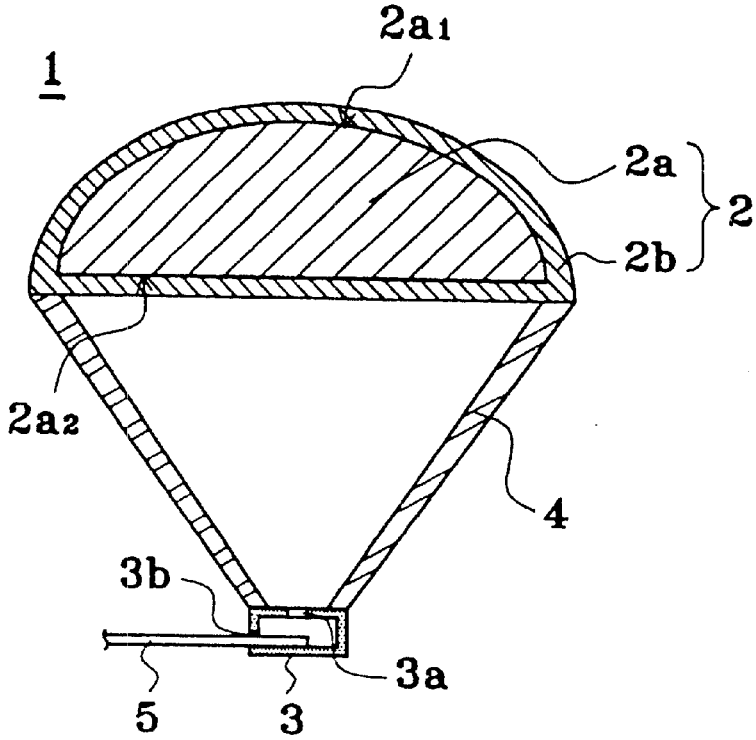
FIG. 1 is a schematic sectional view showing a lens antenna of the present invention.

A composite dielectric molded product of the present invention is formed by molding a composite dielectric material comprising a dielectric inorganic filler and an organic polymer resin so that the dielectric constant anisotropy of a desired structural portion of the molded product lies in the range of about 1.00 to 1.05.

The dielectric constant anisotropy represents the ratio (A/B) of dielectric constant A in the direction in which the dielectric constant is maximum to dielectric constant B in a direction in which the dielectric constant is minimum. As a measuring method, a method of measuring the dielectric constants of ten test pieces obtained from desired portions of the composite dielectric molded product while rotating the test pieces is used.

The dielectric constant of the composite dielectric molded product is substantially determined by the dielectric inorganic filler, and can thus be controlled by controlling the type and amount of the dielectric inorganic filler added. The dielectric inorganic filler preferably comprises at least one number selected from oxides, carbonates, phosphates and silicates of IIa, IVa, IIIb or IVb group elements, and compound oxides of IIa, IVa, IIIb or IVb group elements. Examples of such fillers include $TiO_2$, $CaTiO_3$, $MgTiO_3$, $Al_2O_3$, $BaTiO_3$, $SrTiO_3$, $CaCO_3$, $Ca_2P_2O_7$, $SiO_2$, $Mg_2SiO_4$, $Ca_2MgSi_2O_7$, $Ba(Mg_{1/3}Ta_{2/3})O_3$ and the like.

The ratio of the dielectric inorganic filler added to the composite dielectric material is preferably about 1.0 to 55 volume %, and more preferably about 10 to 55 volume %. This is because with the dielectric inorganic filler added at a ratio of about 55 volume % or less, the composite dielectric material can easily be injection-molded, and with a ratio of about 1.0 volume % or more, a practical dielectric constant can be ensured.

As the organic polymer material, a thermoplastic resin is preferably used because it can be injection-molded. Examples of the organic polymer material include polyethylene, polypropylene, polystyrene, syndiotactic polystyrene, liquid crystal polymers, polyphenylene sulfide, ABS resins, polyester resins, polyacetal, polyamide, methylpentene polymer, norbornene resins, polycarbonate, polyphenylene ether, polysulfone, polyimide, polyether imide, polyamidoimide, polyether ketone, and the like. Particularly, polyethylene, polypropylene, polystyrene, syndiotactic polystyrene, liquid crystal polymers, and polyphenylene sulfide are preferred because the Q value at a radio frequency is high.

When the organic polymer material comprises the thermoplastic resin containing a resin filler, any one of the above-described thermoplastic resins can be used as the thermoplastic resin serving as a matrix. As the resin filler, besides the above-described thermoplastic resins, thermosetting resins such as epoxy resins, melamine resins, urethane resins, silicone resins, and the like can also be used. However, when using a thermoplastic resin as the resin filler, a thermoplastic resin which is not melted at the molding temperature of the thermoplastic resin selected as the thermoplastic matrix resin is selected.

The ratio of the resin filler added to the composite dielectric material is preferably about 1.0 to 45 volume %, and more preferably about 10 to 45 volume %. This is because with an excessively large amount of the resin filler added, it is difficult to injection-mold the composite dielectric material, while with an excessively small amount, orientation of the dielectric inorganic filler cannot be easily suppressed.

Since the dielectric constant anisotropy of the composite dielectric material can be decreased even when it is injection-molded, the melt viscosity is preferably about 170 Pa·s or more, and more preferably about 200 Pa·s or more, at a shear rate of 1000 $S^{-1}$. Although the upper limit of viscosity depends upon the performance of a molding machine, and is thus not limited, the viscosity is preferably about 8000 Pa·s or less from the viewpoint of the performance of currently available molding machines.

A lens antenna of the present invention will be described below. FIG. 1 is a schematic drawing illustrating the lens antenna of the present invention.

The lens antenna 1 of the present invention comprises a lens unit 2, a wave guide (primary transmitter) 3, and a support plate 4 engaged with the lens unit 2 and the primary transmitter 3.

The lens unit 2 comprises a lens body 2*a* and a matching layer 2*b*, the lens body 2 comprising the composite dielectric molded product of the present invention, which is formed by injection molding so that the outgoing plane $2a_1$ has a convex shape and a circular-arc vertical section, and the incidence plane $2a_2$ has a plate-like shape. The matching layer 2*b* is provided for matching the lens body 2*a* with the atmosphere, and comprises the composite dielectric molded product of the present invention, like the lens body 2*a*. The matching layer 2*b* is molded in such a shape as to cover the outer periphery of the lens body 2*a*, and bonded to the lens body 2*a*. The matching layer 2*b* has a relative dielectric constant which is preferably the same as or close to the square root of the relative dielectric constant of the lens body 2*a*. Also, the thickness of the matching layer 2*b* is preferably about ¼ of the wavelength of a desired microwave.

In this embodiment, the primary transmitter comprises the wave guide 3 made of aluminum and having the shape of a rectangular prism. The wave guide 3 has a transmitting aperture 3*a* formed in the upper surface, and an insertion aperture 3*b* formed in the side, the apertures 3*a* and 3*b* communicating with each other in the wave guide 3.

The support plate 4 has a conical shape which widens toward the edge periphery of the lens unit 2, and is provided for fixing the positional relation between the wave guide 3 and the lens unit 2. Also, the inner surface of the support plate 4 is plated with a metal so as to reflect electromagnetic waves.

A dielectric line 5 is inserted from the insertion aperture 3*b* so that the end reaches the position of the transmitting aperture 3*a*. Although not shown in the drawing, an electrode is formed on the dielectric line 5.

The composite dielectric molded product of the present invention will be described in further detail below with reference to examples.

EXAMPLES

Example 1

Figure 2:
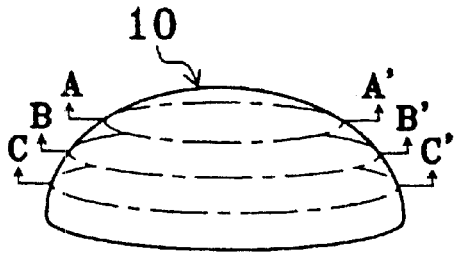
FIG. 2 is a schematic perspective view showing a composite dielectric molded product of the present invention.
Figure 3A:
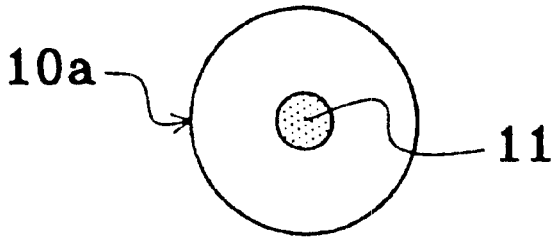
FIGS. 3A–3C are horizontal sectional views of a composite dielectric material of the present invention.
Figure 3B:
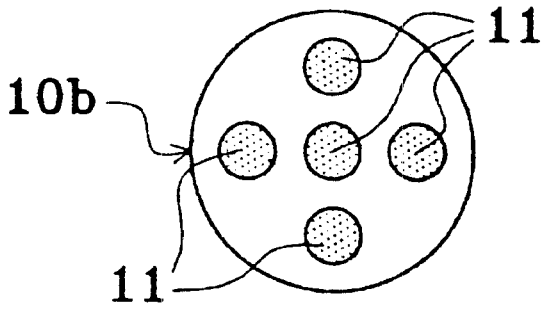
Figure 3C:
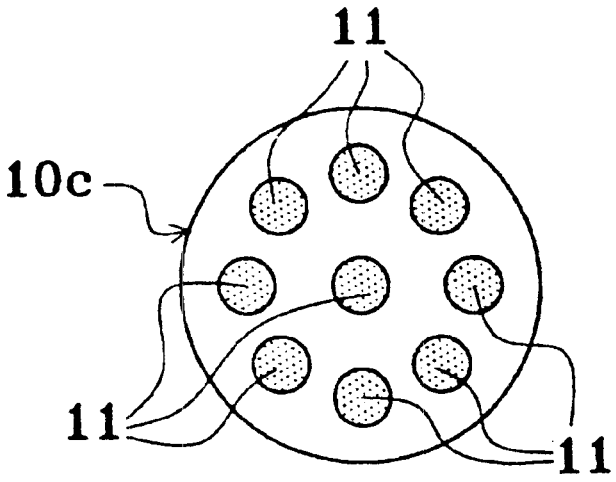

The composite dielectric molded product of the present invention will be described below. FIG. 2 is a schematic perspective view showing the composite dielectric molded product of the present invention, and FIG. 3 is a horizontal sectional view of the composite dielectric material of the present invention. FIG. 3A is a sectional view taken along line A–A' in FIG. 2; FIG. 3B is a sectional view taken along line B-B' in FIG. 2; FIG. 3C is a sectional view taken along line C–C' in FIG. 2.

First, a $CaTiO_3$ powder and a polypropylene powder were prepared as the dielectric inorganic filler and the organic polymer material, respectively, and weighed in the mixing ratios shown in Table 1. These materials were pre-mixed by a Henschel mixer to form a mixed powder. Next, the thus-obtained mixed powder was kneaded in the melt state by using a biaxial extruder at a cylinder temperature of 200° C. to prepare a composite dielectric material, and then molded into yarns by passing through head orifices. The resultant molded product was cooled in water, and then cut in about ϕ 2×5 mm to obtain pellets. The thus-obtained pellets were put in an injection molding machine, melted, and injection-molded into a convex lens-like shape having a diameter of 73.2 mm and a maximum thickness of 20 mm to obtain a composite dielectric molded product. In injection molding, the melt viscosity of each sample was measured at a shear rate of 1000 $S^{-1}$.

Next, the dielectric constant anisotropy and dielectric constant of the resultant composite dielectric molded product were measured. The dielectric constant was measured by a perturbation method using an electric field of 12 GHz in the TEO1d mode. The dielectric constant anisotropy was measured as follows. First, as shown in FIG. 2, the composite dielectric molded product 10 was divided into four equal parts by the A–A' plane, the B–B' plate and the C–C' plane in the thickness direction, and a total of 15 samples 11 were cut out from the sections 10*a*, 10*b* and 10*c*, as shown in FIG. 3. Next, the dielectric constant of each of the samples 11 was measured by the perturbation method using an electric field in the TE10 mode while rotating the direction of the electric field by 30° each. Then, the ratio between the maximum dielectric constant to the minimum dielectric constant of each sample was calculated as the dielectric constant anisotropy, and the dielectric constant anisotropy values of the samples were averaged to determine the dielectric constant anisotropy of the composite dielectric molded product.

The results are shown in Table 1. In Table 1, mark * denotes the samples out of the range of the present invention.

TABLE 1

| Sample No. | $CaTiO_3$ amount (vol %) | Polypropylene amount (vol %) | Melt viscosity in injection molding (Pa · s) | Dielectric constant anisotropy | Dielectric constant ∈r | Variation in dielectric constant 3σ |
|---|---|---|---|---|---|---|
| *1 | 11.2 | 88.8 | 122 | 1.07 | 3.9 | 0.38 |
| *2 | 19.5 | 80.5 | 160 | 1.06 | 5.8 | 0.33 |
| 3 | 26.6 | 73.4 | 180 | 1.05 | 7.8 | 0.3 |
| 4 | 29.1 | 70.9 | 200 | 1.02 | 8.8 | 0.1 |
| 5 | 35.6 | 64.4 | 260 | 1.01 | 12.5 | 0.07 |
| 6 | 40 | 60 | 285 | 1.006 | 14.9 | 0.05 |

Table 1 indicates that with a dielectric constant anisotropy in the range of about 1.00 to 1.05, the dielectric constant varies less.

The reason for limiting the dielectric constant anisotropy of the composite dielectric molded product to about 1.00 to 1.05 is that like in Sample Nos. 1 and 2, with a dielectric constant anisotropy of more than about 1.05, the dielectric constant undesirably varies widely.

Also, the reason for limiting the melt viscosity of the composite dielectric material to about 170 Pa·s or more at a shear rate of 1000 $S^{-1}$ during injection molding is that like in Sample Nos. 1 and 2, with a melt viscosity of less than about 170 Pa·s, the dielectric inorganic filler contained in the composite dielectric material is easily oriented in a direction to undesirably increase the dielectric constant anisotropy to over 1.05.

Example 2

The types and mixing ratio of the dielectric inorganic filler and the organic polymer material were set as shown in Table 2 to obtain a mixed powder for forming a composite dielectric molded product having a dielectric constant εr of about 4.0. The purpose for setting the dielectric constants of samples to a constant value was to simply compare the gains and side lobes of the samples. Next, a composite dielectric molded product was obtained from the resultant mixed powder by the same method as Example 1. The melt viscosity of the composite dielectric material, the dielectric constant anisotropy and dielectric constant of the composite dielectric molded product were measured by the same methods as Example 1. Furthermore, the side lobe was measured by using an electric field of 76 GHz in the TE10 mode in an anechoic chamber. The results are shown in Table 2.

TABLE 2

| Sample No. | Dielectric inorganic filler Type | Dielectric inorganic filler Amount (vol %) | Organic polymer material Type | Organic polymer material Amount (vol %) | Melt viscosity in injection molding (Pa · s) | Variation in dielectric constant 3σ | Dielectric constant anisotropy | Gain (dbi) | Side lobe (db) |
|---|---|---|---|---|---|---|---|---|---|
| *11 | $CaTiO_3$ | 11.2 | PP | 83.8 | 135 | 0.34 | 1.055 | 31.0 | −11 |
| | $Al_2O_3$ | 5 | | | | | | | |
| *12 | $SrTiO_3$ | 10 | PP | 90 | 119 | 0.4 | 1.07 | 30.5 | −8 |
| *13 | $CaTiO_3$ | 10 | PS | 90 | 130 | 0.38 | 1.06 | 30.0 | −9 |
| 14 | $CaTiO_3$ | 4 | PP | 71 | 200 | 0.15 | 1.03 | 31.5 | −19 |
| | $CaCO_3$ | 25 | | | | | | | |
| 15 | $MgTiO_3$ | 23 | PP | 77 | 180 | 0.09 | 1.02 | 32.0 | −20 |
| 16 | $CaTiO_3$ | 4 | PP | 71 | 200 | 0.15 | 1.03 | 31.5 | −19 |
| | $Al_2O_3$ | 25 | | | | | | | |

TABLE 2-continued

| Sample No. | Dielectric inorganic filler Type | Amount (vol %) | Organic polymer material Type | Amount (vol %) | Melt viscosity in injection molding (Pa · s) | Variation in dielectric constant 3σ | Dielectric constant anisotropy | Gain (dbi) | Side lobe (db) |
|---|---|---|---|---|---|---|---|---|---|
| 17 | $CaCO_3$ | 36 | PP | 64 | 260 | 0.09 | 1.02 | 32.0 | −20 |
| 18 | $Al_2O_3$ | 34 | PP | 66 | 250 | 0.07 | 1.01 | 32.5 | −22 |
| 19 | $Mg_2SiO_4$ | 45 | PP | 55 | 550 | 0.05 | 1.002 | 32.5 | −22 |
| 20 | glass beads | 49 | PP | 51 | 500 | 0.05 | 1.002 | 31.0 | −22 |
| 21 | $BaTi_4O_9$<br>$Al_2O_3$ | 10<br>15 | PP | 75 | 170 | 0.2 | 1.04 | 31.5 | −15 |
| 22 | $CaCO_3$ | 20 | PPS | 80 | 180 | 0.07 | 1.01 | 32.0 | −22 |
| 23 | glass fiber | 26 | PPS | 74 | 300 | 0.15 | 1.03 | 31.2 | −19 |
| 24 | $Al_2O_3$ | 20 | PPS | 80 | 170 | 0.07 | 1.01 | 32.0 | −21 |
| 25 | $ZrTiO_4$ | 18 | PS | 82 | 180 | 0.1 | 1.02 | 32.0 | −20 |
| 26 | $SnTiO_4$ | 18 | PS | 82 | 180 | 0.09 | 1.02 | 32.0 | −20 |
| 27 | $CaCO_3$ | 33 | SPS | 67 | 300 | 0.09 | 1.02 | 31.5 | −20 |

*: Samples out of the range of the present invention
PP: Polypropylene
PS: Polystyrene
PPS: Polyphenylene sulfide
SPS: Syndiotactic polystyrene
Measurement temperature of melt viscosity: PP; 200° C., PPS; 300° C., PS; 200° C., SPS; 280° C.

Table 2 indicates that in Sample Nos. 14 to 27 having a dielectric constant anisotropy in the range of about 1.00 to 1.05, even when the types of the dielectric inorganic filler and the organic polymer material are changed, the dielectric constant varies less to obtain good values of both the gain and the side lobe. On the other hand, in Sample Nos. 11 to 13 having a dielectric constant anisotropy of more than about 1.05, the variation in the dielectric constant is increased by 2 times or more to fail to obtain good values of both the gain and side lobe.

Example 3

A $CaTiO_3$ powder and $Al_2O_3$ powder as dielectric inorganic fillers, a polypropylene power as the thermoplastic matrix resin, and a syndiotactic polystyrene powder as a resin filler were prepared, and weighed at the mixing ratios shown in Table 3. These materials were then pre-mixed by a Henschel mixer to obtain a mixed powder. Next, a composite dielectric molded product was obtained from the resultant mixed powder in the same method as Example 1.

The dielectric constant anisotropy and dielectric constant of the thus-obtained composite dielectric molded product were measured by the same methods as Example 1. The results are shown in Table 3. In Table 3, mark * denotes a sample out of the range of the present invention.

In Sample Nos. 28 to 30, the same amount of the dielectric inorganic filler as Sample 1 (Table 1) as a comparative example of Example 1 was added, and the resin filler was added to the thermoplastic resin. In Sample Nos. 31 to 33, the same amount of the dielectric inorganic filler of Sample 3 (Table 1) of Example 1 was added, and the resin filler was added to the thermoplastic resin. In Sample Nos. 34 to 36, the same amount of the dielectric inorganic filler of Sample 11 (Table 2) as a comparative example of Example 2 was added, and the resin filler was added to the thermoplastic resin. In Sample Nos. 37 to 39, the same amount of the dielectric inorganic filler of Sample 16 (Table 2) of Example 2 was added, and the resin filler was added to the thermoplastic resin.

TABLE 3

| Sample No. | Dielectric inorganic filler Type | Amount (vol %) | Thermoplastic matrix resin Type | Amount (vol %) | Resin filler Type | Amount (vol %) | Dielectric constant anisotropy | Variation in dielectric constant 3σ |
|---|---|---|---|---|---|---|---|---|
| *1 | $CaTiO_3$ | 11.2 | PP | 88.8 | — | 0 | 1.07 | 0.38 |
| *11 | $CaTiO_3$<br>$Al_2O_3$ | 11.2<br>5 | PP | 83.8 | — | 0 | 1.055 | 0.34 |
| 28 | $CaTiO_3$ | 11.2 | PP | 43.8 | SPS | 45 | 1.008 | 0.07 |
| 29 | $CaTiO_3$ | 11.2 | PP | 64.8 | SPS | 24 | 1.025 | 0.1 |
| 30 | $CaTiO_3$ | 11.2 | PP | 78.8 | SPS | 10 | 1.05 | 0.3 |
| 31 | $CaTiO_3$ | 26.6 | PP | 43.4 | SPS | 30 | 1.04 | 0.2 |
| 32 | $CaTiO_3$ | 26.6 | PP | 53.4 | SPS | 20 | 1.02 | 0.1 |
| 33 | $CaTiO_3$ | 26.6 | PP | 63.4 | SPS | 10 | 1.01 | 0.07 |
| 34 | $CaTiO_3$<br>$Al_2O_3$ | 11.2<br>5 | PP | 38.8 | SPS | 45 | 1.005 | 0.06 |
| 35 | $CaTiO_3$<br>$Al_2O_3$ | 11.2<br>5 | PP | 59.8 | SPS | 24 | 1.02 | 0.09 |

TABLE 3-continued

| Sample No. | Dielectric inorganic filler Type | Amount (vol %) | Thermoplastic matrix resin Type | Amount (vol %) | Resin filler Type | Amount (vol %) | Dielectric constant anisotropy | Variation in dielectric constant 3σ |
|---|---|---|---|---|---|---|---|---|
| 36 | $CaTiO_3$<br>$Al_2O_3$ | 11.2<br>5 | PP | 73.8 | SPS | 10 | 1.04 | 0.2 |
| 37 | $CaTiO_3$<br>$Al_2O_3$ | 4<br>25 | PP | 41 | SPS | 30 | 1.025 | 0.13 |
| 38 | $CaTiO_3$<br>$Al_2O_3$ | 4<br>25 | PP | 51 | SPS | 20 | 1.02 | 0.1 |
| 39 | $CaTiO_3$<br>$Al_2O_3$ | 4<br>25 | PP | 61 | SPS | 10 | 1.008 | 0.06 |

PP: Polypropylene
SPS: Syndiotactic polystyrene

Table 3 indicates that with the thermoplastic matrix resin containing the resin filler, the dielectric constant anisotropy is in the range of about 1.00 to 1.05, and thus the dielectric constant varies less.

A composite dielectric molded product of the present invention is formed by molding a composite dielectric material containing a dielectric inorganic filler and an organic polymer material so that the dielectric constant anisotropy lies in the range of about 1.00 to 1.05. Therefore, the electric properties can be improved and the variation in the properties can be decreased.

Also, a thermoplastic resin is selected as the organic polymer material, and the melt viscosity of the composite dielectric material is set to about 170 Pa·s or more at a shear rate of 1000 $S^{-1}$ to permit injection molding of the composite dielectric material. Therefore, the production cost can be decreased and molding can be easily performed with high precision of shape.

Furthermore, a thermoplastic resin containing a resin filler is selected as the organic polymer material and thus orientation of the dielectric inorganic filler can be suppressed to decrease the dielectric constant anisotropy.

The dielectric inorganic filler is at least one selected from oxides, carbonates, phosphates and silicates of IIa, IVa, IIIb or IVb group elements, and compound oxides of IIa, IVa, or IVb group elements, thereby obtaining a high dielectric constant even when the composite dielectric molded product is thin.

By using the composite dielectric molded product of the present invention for a lens antenna, the lens antenna has a large antenna gain, a low side lobe and less variation in properties.

What is claimed is:

1. A composite dielectric molded product comprising a composite dielectric material containing a dielectric inorganic filler and an organic polymer material;

wherein the dielectric constant anisotropy, which is the ratio (A/B) of dielectric constant A in a direction in which the dielectric constant is maximum to dielectric constant B in a direction in which the dielectric constant is minimum, is in the about 1.00 to 1.05.

2. A composite dielectric molded product according to claim 1, wherein the dielectric inorganic filler is about 1–55 vol % of the composite dielectric material.

3. A composite dielectric molded product according to claim 2, wherein the dielectric inorganic filler is about 10–55 vol % of the composite dielectric material.

4. A composite dielectric molded product according to claim 2, wherein the composite dielectric material has a melt viscosity of about 170 Pa·s or more at a shear rate of 1000 $S^{-1}$.

5. A composite dielectric molded product according to claim 1, wherein the composite dielectric material has a melt viscosity of about 170 Pa·s or more at a shear rate of 1000 $S^{-1}$.

6. A composite dielectric molded product according to claim 1, wherein the organic polymer material comprises a thermoplastic resin.

7. A composite dielectric molded product according to claim 1, wherein the organic polymer material comprises a thermoplastic resin containing a resin filler.

8. A composite dielectric molded product according to claim 7, wherein the resin filler is about 1–45 vol % of the organic polymer material.

9. A composite dielectric molded product according to claim 1, wherein the dielectric inorganic filler is at least one member selected from the group consisting of oxides, carbonates, phosphates and silicates of IIa, IVa, IIIb or IVb group elements, and compound oxides containing IIa, IVa, IIIb or IVb group elements.

10. A composite dielectric molded product according to claim 1, wherein the dielectric inorganic filler is about 1–55 vol % of the composite dielectric material, and the composite dielectric material has a melt viscosity of about 170 Pa·s or more at a shear rate of 1000 $S^{-1}$.

11. A composite dielectric molded product according to claim 10, wherein the dielectric inorganic filler is about 10–55 vol % of the composite dielectric material, the organic polymer material comprises a thermoplastic resin and wherein the composite dielectric material has a melt viscosity of about 200 to 8000 Pa·s at a shear rate of 1000 $S^{-1}$.

12. A lens antenna comprising at least a lens unit having a convex outgoing plane, and a primary transmitter behind the lens unit;

wherein the lens unit comprises a composite dielectric molded product according to claim 11.

13. A lens antenna according to claim 12, wherein the lens unit comprises a lens body having a surface and a matching layer on the surface of the lens body, for matching the lens body with the air.

14. A lens antenna according to claim 13, wherein the matching layer has a relative dielectric constant which is approximately the same as the square root of the relative dielectric constant of the lens body.

15. A lens antenna comprising at least a lens unit having a convex outgoing plane, and a primary transmitter behind the lens unit;

wherein the lens unit comprises a composite dielectric molded product according to claim 5.

16. A lens antenna according to claim 15, wherein the lens unit comprises a lens body having a surface and a matching layer on the surface of the lens body, for matching the lens body with the air.

17. A lens antenna according to claim 16, wherein the matching layer has a relative dielectric constant which is approximately the same as the square root of the relative dielectric constant of the lens body.

18. A lens antenna comprising at least a lens unit having a convex outgoing plane, and a primary transmitter behind the lens unit;

wherein the lens unit comprises a composite dielectric molded product according to claim 1.

19. A lens antenna according to claim 18, wherein the lens unit comprises a lens body having a surface and a matching layer on the surface of the lens body, for matching the lens body with the air.

20. A lens antenna according to claim 19, wherein the matching layer has a relative dielectric constant which is approximately the same as the square root of the relative dielectric constant of the lens body.

* * * * *